US005788829A

United States Patent [19]

Joshi et al.

[11] Patent Number: 5,788,829

[45] Date of Patent: Aug. 4, 1998

[54] METHOD AND APPARATUS FOR CONTROLLING PLATING THICKNESS OF A WORKPIECE

[75] Inventors: Swati V. Joshi; Robert R. Botts; Louis W. Nicholls, all of Durham, N.C.

[73] Assignee: Mitsubishi Semiconductor America, Inc., Durham, N.C.

[21] Appl. No.: 732,654

[22] Filed: Oct. 16, 1996

[51] Int. Cl.[6] ..... C25D 5/00; C25D 17/08

[52] U.S. Cl. ..... 205/96; 204/228; 204/287; 204/297 W; 204/DIG. 7

[58] Field of Search ..... 205/96, 97; 204/DIG. 7, 204/224 R, 228, 297 R, 297 W, 287

[56] References Cited

U.S. PATENT DOCUMENTS

| | | | |
|---|---|---|---|
| 1,625,484 | 4/1927 | Mason | 205/711 |
| 3,499,832 | 3/1970 | Hearn, Jr. | 204/297 W |
| 3,862,891 | 1/1975 | Smith | 205/96 |
| 3,923,631 | 12/1975 | Palisin, Jr. | 204/297 W |
| 3,939,056 | 2/1976 | Fueki et al. | 204/297 W |
| 3,954,569 | 5/1976 | Vanderveer et al. | 205/95 |
| 4,012,309 | 3/1977 | Eslien et al. | 204/297 W |
| 4,067,782 | 1/1978 | Bailey et al. | 205/151 |
| 4,077,864 | 3/1978 | Venderveer et al. | 204/285 |
| 4,233,149 | 11/1980 | Toda et al. | 204/297 W |
| 4,243,146 | 1/1981 | Davitz | 211/118 |
| 4,247,382 | 1/1981 | Smith et al. | 204/297 R |
| 4,591,420 | 5/1986 | Van Horn | 204/297 W |
| 4,855,020 | 8/1989 | Sirbola | 205/137 |
| 4,872,963 | 10/1989 | Van Horn | 204/297 W |
| 4,933,061 | 6/1990 | Kulkarni et al. | 204/224 R |
| 5,020,677 | 6/1991 | Wirth et al. | 211/113 |
| 5,149,419 | 9/1992 | Sexton et al. | 205/75 |
| 5,401,370 | 3/1995 | Kauper et al. | 204/228 |
| 5,516,412 | 5/1996 | Andricacos et al. | 204/224 R |

OTHER PUBLICATIONS

F.A. Lowenheim, Electroplating, McGraw-Hill Book Co., New York, 1978, pp. 152–155, 329–331 No Month Available.

*Primary Examiner*—Kathryn L. Gorgos
*Assistant Examiner*—William T. Leader
*Attorney, Agent, or Firm*—Lowe, Price, LeBlanc & Becker

[57] ABSTRACT

A method and apparatus for electroplating a workpiece to achieve a uniform plating thickness includes a cathode rack having a hook from which the workpiece is suspended and spaced apart from a consumable anode. The rack includes a plurality of plates made of the same material as the anode disposed on opposite sides of the rack. The plates direct a portion of the current emanating from the anode away from the workpiece to produce more uniform plating.

10 Claims, 1 Drawing Sheet

METHOD AND APPARATUS FOR CONTROLLING PLATING THICKNESS OF A WORKPIECE

TECHNICAL FIELD

The present invention relates to a method and apparatus for use in an electroplating process, and more particularly, to a method and apparatus for providing a uniform plating thickness by using anode material as a part of the cathode of the electroplating apparatus.

BACKGROUND ART

During manufacture of semiconductor chips for mounting on printed circuit boards carrying the chips and other circuit components, the conductors of the chips are electroplated with a solder material comprising tin and lead to improve solderability of the chip to the board. The step of electroplating is typically performed while several semiconductor chips are mounted on a lead frame suspended by hooks on a cathode rack placed in an electroplating bath. The bath contains an anode which conducts an electrical current which passes to the cathode rack and lead frames to deposit metal on the lead frames, especially on the outer leads of the semiconductor chips. After electroplating, the lead frames are severed and the individual semiconductor chips are separated.

The thickness of the deposited metal is a function of the current density which in turn is a function of the current distribution that is primarily influenced by the geometry of the plating bath. The positive electrode in the plating bath, the anode, conducts the current into the plating solution and produces an electric field between the anode and the cathode rack from which the workpiece is suspended. The electrical field influences the current distribution, and thus the thickness of the deposited metal, over the workpiece surface. Because the field strength of the electric field is greater on the edges than at the center of the workpiece, the electroplating thickness tends to be greater at the edges. Additionally, the design and construction of the cathode rack also influences the metal distribution over the surface of the workpiece.

One example of a prior art cathode rack is depicted in FIG. 1. The rack 1 is generally rectangular in shape and includes upper surface hooks 2 permitting the rack to be suspended from a frame or the side of a tank (not shown) and immersed in the electroplating bath. A plurality of hooks 3 hang from a horizontal bar 4 to support workpieces.

A conventional electric field distribution that may be produced in an electroplating bath is schematically depicted in FIG. 2. The electric field 5 emanates from anode 6 toward cathode rack 1 and workpieces 7. As depicted, the current is attracted to the sides 8, 9 of cathode rack 1 such that the field strength of the electric field 5 is greater at sides 8, 9 than at the center of the cathode rack. Because of this fringing of the electric field, the plating thickness disadvantageously tends to be greater for workpieces at sides 8, 9 of cathode rack 1 than those near the middle of the cathode rack.

Various attempts have been made to improve the distribution of plating materials on a workpiece. For instance, U.S. Pat. Nos. 3,954,569 and 4,077,864 to Vanderveer et al. disclose an electroforming method and apparatus including a shielded anode basket housing nickel chips. The anode basket is covered by non-conductive shields, each including a cut-out to expose a predetermined area of the anode to the workpiece cathode. By reducing the exposed anode area, a higher tank voltage can be utilized. These anode shields improve ductility of the electroformed surface by increasing the anode current density while maintaining the higher voltage level, but do not control plating thickness over the entire surface area of the workpiece.

Other attempts to control the plating thickness of a workpiece include the provision of a pumping device to redirect the electrolytic plating solution from the bottom of a tank upward, as disclosed in U.S. Pat. No. 4,933,061 to Kulkarni et al. This apparatus is complex and thus not well suited for use with semiconductor lead frames.

Accordingly, one advantage of the present invention is in producing a uniform plating thickness along the entire surface of a workpiece within an electroplating apparatus.

Another advantage is in providing an improved electroplating apparatus wherein current is redirected away from the workpiece to control the plating thickness over the entire workpiece surface.

Yet another advantage is in providing an improved method of electroplating a workpiece resulting in a uniform plating thickness over the entire surface of a workpiece.

DISCLOSURE OF THE INVENTION

The above and other objects of the invention are achieved, at least in part, by providing an improved apparatus for electroplating a workpiece with an electroplate metal. The invention provides structure that advantageously redirects the current away from the edges of the workpiece and alters electric field distribution between the anode and cathode of the apparatus. The resulting altered electric field uniformly encounters the workpiece suspended by the cathode, resulting in a uniform distribution of deposited plating throughout the workpiece.

The apparatus is of a type that includes an anode including particles formed of an anode material. A cathode rack supporting the workpiece includes a plate of anode material disposed on at least one end of the rack. The anode and the cathode rack are immersed in an electroplating bath. The apparatus, when energized, produces current emanating from the anode toward the cathode to deposit the electroplate metal on the workpiece. A portion of the current is redirected to the plate away from the workpiece.

According to a preferred embodiment, the cathode rack includes a plurality of plates formed of anode material on opposite sides of the rack. A plurality of hooks are disposed on the sides of the rack from which the plurality of plates are suspended.

The invention is also directed to a method of electroplating a workpiece. The workpiece, supported by a cathode rack, together with an anode basket containing anode particles is immersed in an electroplating bath. Current is caused to flow from the anode to the cathode to deposit the electroplate metal on the workpiece. A portion of the current is redirected by the plates away from the workpiece.

The invention is also directed to a cathode for use in an electroplating apparatus. An anode including anode particles is suspended in an electroplating bath. The apparatus produces current flow between the anode and the cathode to deposit electroplate metal on a workpiece. The cathode, disposed in the electroplating bath, includes a rack having means for supporting the workpiece. A plurality of hooks are disposed along opposite sides of the rack. A plurality of plates are made of an anode material suspended from the plurality of hooks. A portion of the current is redirected away from the workpiece, toward the plurality of plates.

Still other objects and advantages of the present invention will become readily apparent to those skilled in this art from the following detailed description, wherein only the preferred embodiments of the invention are shown and described, simply by way of illustration of the best mode contemplated of carrying out the invention. As will be realized, the invention is capable of other and different embodiments, and its several details are capable of modifications in various obvious respects, all without departing from the invention. Accordingly, the drawing and description are to be regarded as illustrative in nature, and not as restrictive.

BEST MODE FOR CARRYING OUT THE INVENTION

Although the present invention has general applicability in the field of manufacturing and assembly of integrated circuits, and specifically, in the electroplating of the outer leads of semiconductor chips, it is to be understood that the present invention is also applicable for use with any electroplating apparatus and process in which achieving a uniform plating thickness is desired.

Figure 1:
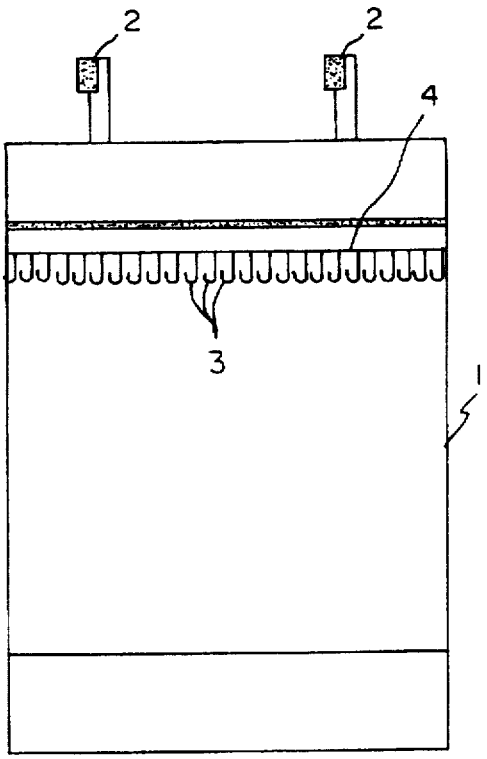
Figure 1 PRIOR ART
FIG. 1 is a front view of a prior art cathode rack.
Figure 3:
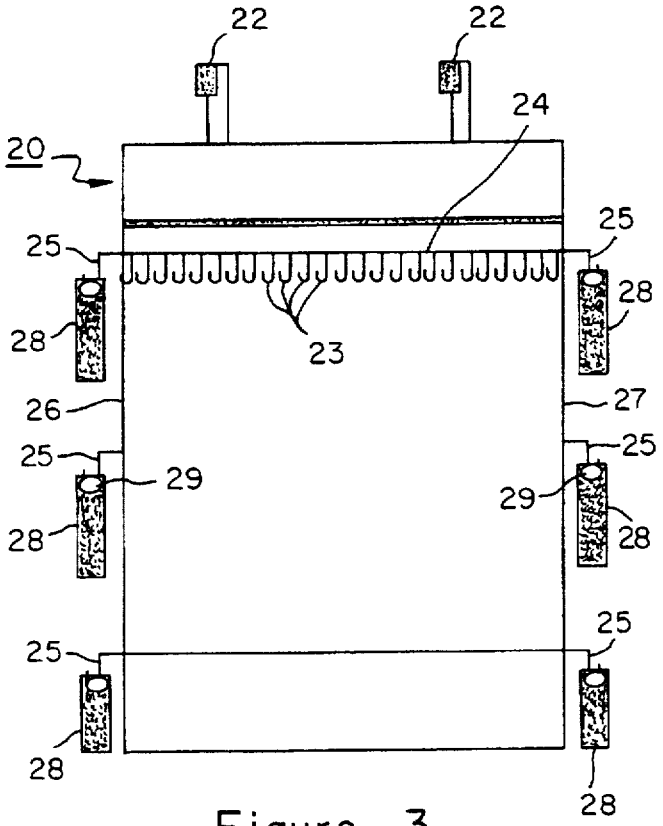
FIG. 3 is a front view of a cathode rack according to the present invention.
Figure 4:
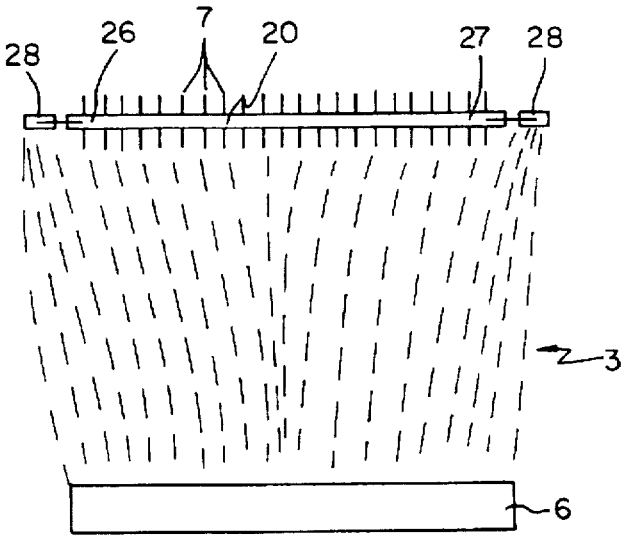
FIG. 4 is a schematic illustration of the flow of current from the anode to the cathode in an electroplating apparatus including the cathode rack of present invention.

Referring to FIGS. 3 and 4 of the present invention, an improved cathode rack 20 is a modification of the prior art rack of FIG. 1. Thus, cathode rack 20 is similar to prior art cathode rack 1 in that it is generally rectangular in shape and includes upper surface hooks 22 permitting the rack to be suspended from a frame or the side of a tank (not shown) and immersed in an electroplating bath. A plurality of hooks 23 hang from a horizontal bar 24 to support a number of workpieces (not shown). In accordance with the invention, cathode rack 20 is modified to include hooks 25 disposed opposite sides 26, 27 of the rack. These hooks 25 support a plurality of plates 28, as seen in FIG. 3. Plates 28 are made of the same material as the anode, which varies with the particular application. For semiconductor outer leads, it is preferred to use a solder material, such as a lead-tin alloy, as the anode material.

As will now be appreciated by one of ordinary skill in the art, the provision of numerous hooks 25 permits the particular locations of the plates 28 to vary. The locations of the plates for a particular application will be determined by the plating thickness distribution sought to be achieved.

Figure 2:
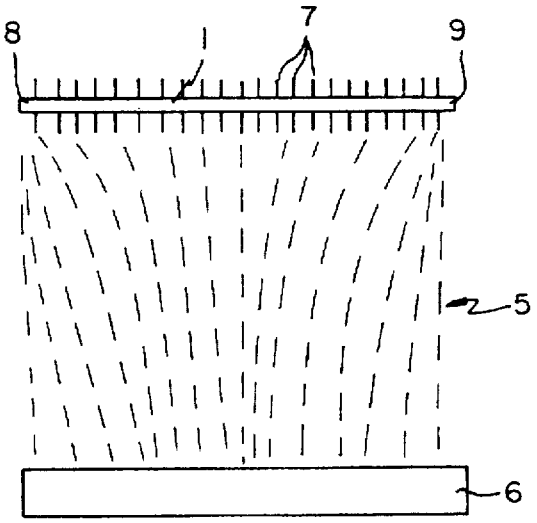
Figure 2 PRIOR ART
FIG. 2 is a schematic illustration of the flow of current from the anode to the cathode in an electroplating apparatus with a prior art cathode rack.

The electric field distribution resulting from the cathode rack 20 of the present invention is schematically depicted in FIG. 4. As previously stated with reference to FIG. 2, the fringing of the electric field results in a field strength greater at the edges than at the center of the cathode rack, with the resulting electroplating thickness tending to be greater for workpieces located at the edges. With plates 28 positioned on cathode rack 20, the plates, rather than the workpieces located at the edges of rack 20, receive the fringes of the electric field. Thus, the greater thickness of electroplating material on the workpieces located at the edges of cathode rack 20, due to the fringing of the electric field, is eliminated. The thickness of the deposited plating is therefore uniformly distributed throughout the workpieces 5 due to the unique placement of anode plates 28.

It now can be seen that the present invention provides a unique apparatus for controlling the electric field distribution between the cathode and the anode of an electroplating apparatus. By adjusting the number and location of plates 28 along the sides of cathode rack 20, the electric field may be manipulated to produce a desired electric field distribution. Although the apparatus of the present invention has been described as altering the electric field to produce a uniform plating thickness across the entire workpiece, it will be appreciated by one of ordinary skill in the art that the apparatus disclosed herein may be utilized to produce a controlled variable plating thickness, as may be required by a particular application. It will be understood that these and other variations are within the scope of the present invention.

In this disclosure, there is shown and described only the preferred embodiment of the invention, but, as aforementioned, it is to be understood that the invention is capable of use in various other combinations and environments and is capable of changes or modifications within the scope of the inventive concept as expressed herein.

We claim:

1. An apparatus for electroplating a workpiece with anode material from a consumable anode, the apparatus comprising:

a consumable anode;

a cathode rack adapted to support the workpiece, the cathode rack bearing at least one plate, consisting essentially of the anode material, disposed at or near one end of the rack; and an electroplating bath in which the anode and the cathode rack including the workpiece are immersed;

wherein, when the apparatus is energized to produce current from the anode toward the cathode to deposit the anode material on the workpiece, a portion of the current is directed away from the workpiece toward the plate.

2. The apparatus of claim 1, wherein the plate is adjustably supported by the cathode rack.

3. The apparatus of claim 1, wherein the anode is a basket containing anode balls of the anode material.

4. The apparatus of claim 1, wherein the anode material is selected from the group consisting of gold, palladium, chrome, tin, tin-lead alloy, or tin-palladium alloy.

5. The apparatus of claim 4, wherein the anode material is a tin-lead alloy.

6. The apparatus of claim 1, wherein the cathode rack comprises sides extending along or proximate ends thereof, a plurality of plates consisting essentially of the anode material disposed on opposite sides of the rack, and means to support a workpiece between the ends.

7. The apparatus of claim 6, wherein the cathode rack includes a plurality of hooks disposed on the ends and/or sides of the rack from which the plurality of plates are suspended.

8. A method of electroplating a workpiece, which method comprises:

(a) supporting the workpiece on a cathode rack comprising sides extending along or proximate ends thereof;

(b) immersing the workpiece and cathode rack in an electroplating bath;

(c) immersing an anode assembly comprising a basket containing pieces of consumable anode material different from the workpiece material in the bath;

(d) providing a current from the pieces of anode material to the cathode to electroplate anode material on the workpiece; and (e) directing a portion of the current away from the workpiece by providing on the cathode rack plates, consisting essentially of the anode material, at or near the ends or opposite sides of the cathode rack.

9. The method according to claim 8, comprising electroplating the outer leads of a semiconductor device with a solder material.

10. The method according to claim 9, wherein the solder material comprises a lead-tin alloy.

* * * * *